US011742165B2

(12) United States Patent
Friedrichsen et al.

(10) Patent No.: US 11,742,165 B2
(45) Date of Patent: Aug. 29, 2023

(54) SWITCHING DEVICE FOR GUIDING AND SWITCHING OF LOAD CURRENTS

(71) Applicant: Eaton Intelligent Power Limited, Dublin (IE)

(72) Inventors: Lutz Friedrichsen, Langerwehe (DE); Christoph Bausch, Bonn (DE); Julia Otte, Cologne (DE); Kai Schroeder, Niederkassel (DE); Johannes Meissner, Bonn (DE); Christian Ruempler, Bonn (DE); Albert Zacharias, Neuwied (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 199 days.

(21) Appl. No.: 17/413,959

(22) PCT Filed: Dec. 16, 2019

(86) PCT No.: PCT/EP2019/085247

§ 371 (c)(1),
(2) Date: Jun. 15, 2021

(87) PCT Pub. No.: WO2020/126976

PCT Pub. Date: Jun. 25, 2020

(65) Prior Publication Data

US 2022/0044896 A1 Feb. 10, 2022

(30) Foreign Application Priority Data

Dec. 18, 2018 (GB) ..... 1820592

(51) Int. Cl.
*H01H 9/00* (2006.01)
*H01H 50/16* (2006.01)
(Continued)

(52) U.S. Cl.
CPC ..... *H01H 50/16* (2013.01); *H01H 9/443* (2013.01); *H01H 50/546* (2013.01)

(58) Field of Classification Search
CPC ..... H01H 50/16; H01H 9/443; H01H 50/546; H01H 33/182; H01H 51/2272; H01H 1/2075
(Continued)

(56) References Cited

U.S. PATENT DOCUMENTS 4,048,600 A 9/1977 Dietrich
2006/0270330 A1* 11/2006 Schmid ..... F16C 31/02 452/58
(Continued)

FOREIGN PATENT DOCUMENTS

EP 2131377 A1 12/2009
GB 548472 A 10/1942

*Primary Examiner* — Shawki S Ismail
*Assistant Examiner* — Lisa N Homza
(74) *Attorney, Agent, or Firm* — Leydig; Voit & Mayer, Ltd.

(57) ABSTRACT

A switching device for guiding and switching of load currents includes: a movable switching component having a first movable contact and a second movable contact; a first fixed contact and a second fixed contact; a supporting device for supporting the switching component; and a magnetic actuator. The first movable contact is in contact with the first fixed contact and the second movable contact is in contact with the second fixed contact in a switched-on state of the switching component. The first movable contact is electrically separated from the first fixed contact and the second movable contact is electrically separated from the second fixed contact in a switched-off state of the switching component. The switching component is arranged such that the switching component moves between the switched-on state and the switched-off state by at least a rotational movement of the switching component and a translational movement of the supporting device.

12 Claims, 4 Drawing Sheets

(51) Int. Cl.
*H01H 9/44* (2006.01)
*H01H 50/54* (2006.01)

(58) Field of Classification Search
USPC ..... 335/177
See application file for complete search history.

(56) References Cited

U.S. PATENT DOCUMENTS

2013/0206729 A1* 8/2013 Lang ..... H01H 33/20
218/148
2013/0264310 A1* 10/2013 Lang ..... H01H 1/20
218/2
2013/0264311 A1* 10/2013 Lang ..... H01H 1/2025
218/2
2013/0313228 A1* 11/2013 Friedrichsen ..... H01H 9/443
218/23
2014/0061160 A1* 3/2014 Juds ..... H01H 9/443
218/26
2014/0151338 A1* 6/2014 Gerving ..... H01H 33/182
218/26
2014/0175060 A1 6/2014 Reymond et al.
2014/0263186 A1* 9/2014 Gerving ..... H01H 9/36
218/26
2014/0360982 A1* 12/2014 Gerving ..... H01H 33/182
218/24
2021/0272758 A1* 9/2021 Friedrichsen ..... H01H 9/443
2021/0304995 A1* 9/2021 Bausch ..... H01H 9/36

* cited by examiner

SWITCHING DEVICE FOR GUIDING AND SWITCHING OF LOAD CURRENTS

CROSS-REFERENCE TO PRIOR APPLICATIONS

This application is a U.S. National Phase application under 35 U.S.C. § 371 of International Application No. PCT/EP2019/085247, filed on Dec. 16, 2019, and claims benefit to British Patent Application No. GB 1820592.2, filed on Dec. 18, 2018. The International Application was published in English on Jun. 25, 2020 as WO 2020/126976 under PCT Article 21(2).

FIELD

The disclosure relates to a switching device for guiding and switching of load currents, for example high DC currents, especially for applications in the field of electromobility.

BACKGROUND

In order to enable a safe switching-off of short-circuit currents in the range of 10 kA or higher, the narrowest possible time limit for the duration of impact of the electric arcs, which are generated from short-circuit currents, on the switching device is of fundamental importance, especially in the case of compact switching devices such as required for use in the driving and charging operation of electric vehicles.

For switching nominal currents with a large number of switching cycles, the service life of the switching device is significantly determined by the capability of the switching device to quickly move away the electric arcs occurring during opening of the switching contacts from the surface of the switching contacts and to extinguish the electric arcs as quickly as possible. Essential elements to realize these requirements are: a fast switching drive with which a fast opening of the contacts with a sufficiently high opening distance, for example larger than 5 mm, can be achieved, an arc driver device based on arc guiding rails, an efficient magnetic blow field arrangement and a suitable arc extinguishing system.

In the event of a short-circuit, especially a high short-circuit current, a fast dynamic opening/rupture of the switching contacts may appear due to the high current forces.

The high energy content of the electric arc, which is generated by the short-circuit current and which can be detected during the opening of the switching contacts, could potentially destroy the switching device. Furthermore, the required galvanic isolation of the switching path of the switching device will no longer occur, if it is not constructively ensured that the energy of the electric arcs can be dissipated within a short time and thus the arcs can be quickly extinguished.

In addition to the mentioned properties of the switching device for the case of nominal currents, an essential criterion for fulfilling this requirement is the constructive configuration of the fixed and the movable switching components of the switching device such that a strong dynamic magnetic blow field is built up in the event of a short-circuit.

EP 2131377 A1 is directed to a relay having a magnetic drive. The magnetic drive comprises an armature which engages in a slider to move the contact spring in respective relay positions. U.S. Pat. No. 4,048,600 A relates to a power relay comprising a pivot armature on which a contact bridge with two contacts is mounted, the two contacts cooperating with contacts on stationary contact carriers. US 2014/0360982 A1 relates to a switching device comprising an arc guiding assembly being provided for guiding an arc arising between a first and second contact toward an extinguishing device. US 2014/0061160 A1 shows a circuit breaker with a direct current arc chute comprising a plurality of arc splitter plates.

It is desired to provide a short-circuit-proof, polarity-independent, remote-controlled compact switching device being capable to perform a high number of switching operations, especially for DC currents, preferably above 100 A, and voltages up to approximately 1000 V.

SUMMARY

In an embodiment, the present invention provides a switching device for guiding and switching of load currents, comprising: a movable switching component having a first movable contact and a second movable contact; a first fixed contact and a second fixed contact; a supporting device configured to support the switching component; and a magnetic actuator, wherein the first movable contact is in contact with the first fixed contact and the second movable contact is in contact with the second fixed contact in a switched-on state of the switching component, wherein the first movable contact is electrically separated from the first fixed contact and the second movable contact is electrically separated from the second fixed contact in a switched-off state of the switching component, wherein the switching component is arranged such that the switching component is configured to move between the switched-on state and the switched-off state by at least a rotational movement of the switching component and a translational movement of the supporting device, wherein the supporting device and the magnetic actuator are configured such that the translational movement of the supporting device is caused by an activation of the magnetic actuator, wherein the switching component has a bearing position at which the switching component is rotatably arranged, wherein the switching component is mechanically coupled to the supporting device at a force application area of the switching component, wherein a location of the force application area is different from a location of the bearing position, wherein the switching component comprises an E-shaped component having a first outer limb, a second outer limb, and a middle limb arranged between the first outer limb and the second outer limb, the middle limb being longer than the first and the second outer limbs, wherein the first movable contact is arranged at an end portion of the first outer limb and the second movable contact is arranged at an end portion of the second outer limb, wherein the bearing position of the switching component is arranged at an end portion of the middle limb, and wherein the force application area is arranged at a position of the middle limb between the bearing position and a virtual connecting line between the first movable contact and the second movable contact.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
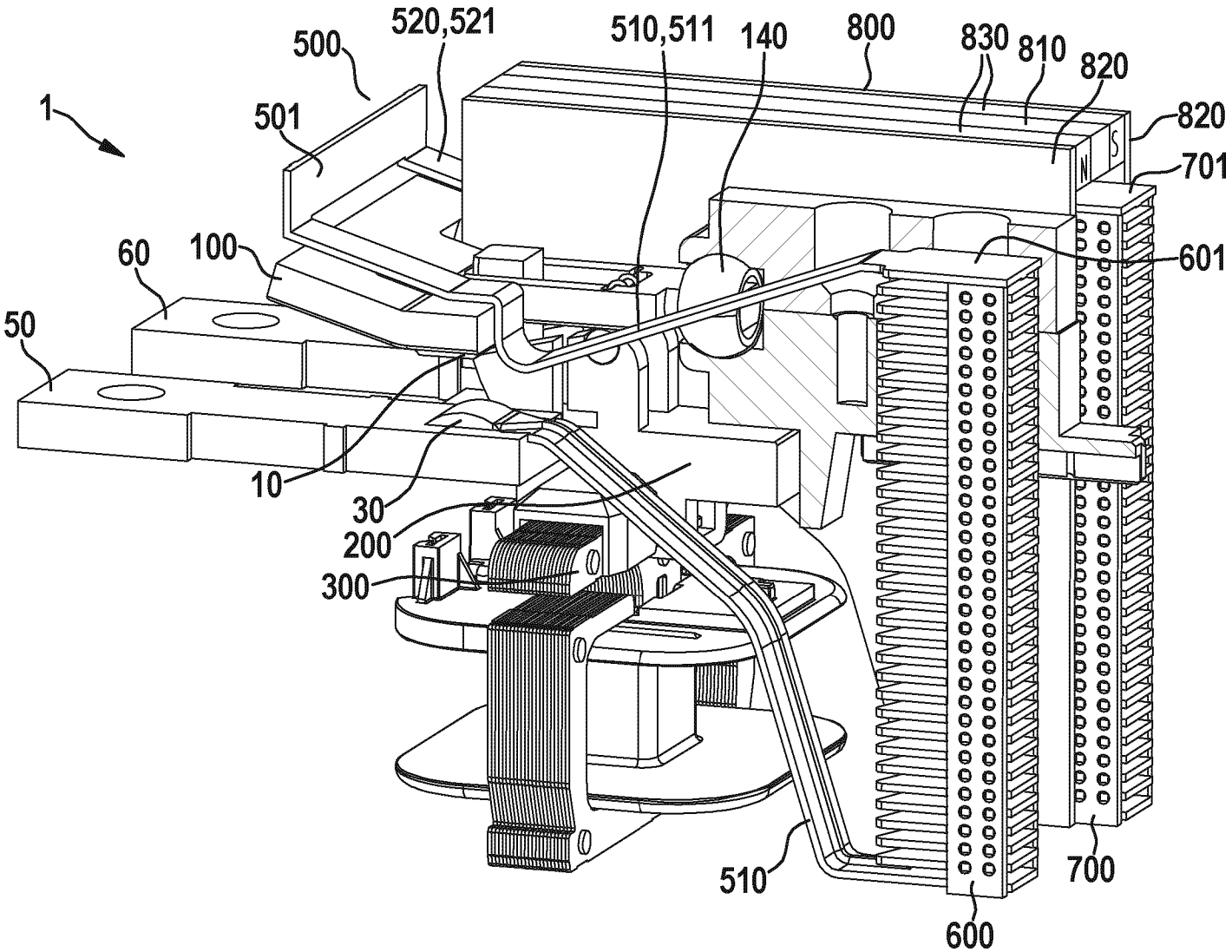
FIG. 1 shows a first embodiment of a switching device for guiding and switching of load currents.

In an embodiment, the present invention provides a switching device for guiding and switching of load currents, wherein the switching device can reliably handle a large number of switching operations.

According to a possible embodiment, the switching device comprises a movable switching component having a first movable contact and a second movable contact. The switching device further comprises a first fixed contact and a second fixed contact. The switching device comprises a supporting device to support the switching component. The first movable contact is in contact with the first fixed contact, and the second movable contact is in contact with the second fixed contact in a switched-on state of the switching component. The first movable contact is electrically separated from the first fixed contact, and the second movable contact is electrically separated from the second fixed contact in a switched-off state of the switching component. Moreover, the switching component is arranged such that the switching component is moved between the switched-on state and the switched-off by at least a rotational movement of the switching component and a translational movement of the supporting device. The switching component has a bearing position at which the switching component is rotatably arranged. The switching component is mechanically coupled to the supporting device at a force application area of the switching component, wherein the location of the force application area is different from the location of the bearing position.

The proposed switching device is embodied as a remote-controlled compact DC switching device for guiding and switching of bidirectional load currents being larger than 100 A and bidirectional over-currents, especially short-circuit currents, being capable of performing a high number of switching operations, for example more than 100.000 switching operations, under nominal load conditions.

The remote-controlled property of the switching device may be realized by using an actuator, for example a magnetic actuator to move the switching component. Thus, the switching device does not need a mechanical lock or a manual switch to move the switching component between the switched-off and the switched-on state.

According to an embodiment of the switching device, the movable switching component does not perform a pure linear movement, but rather performs a rotational movement or a combined linear and rotary motion during the switching operations by means of a suitable connection or joint, for example a ball-and-socket joint bearing, such that a lever action for fast opening of the contacts with an enlarged opening distance is generated, and an additional lever effect for breaking one or both welded contact pairs is provided to reduce the welding tendency when switching-on high currents. By including a rotational component in the movement of the movable switching component, a faster opening may be achieved. This may lead to a reduced welding tendency of the switching contacts.

According to an embodiment of the switching device, the movable switching component is embodied approximately as an E-shaped component to generate an efficient dynamic magnetic blow field, the E-shaped component comprising two outer limbs and a middle limb. The end portion of the middle limb can be embodied as a joint, for example a ball-and-socket joint, which serves for the realization of the combined linear and rotary switching movement of the movable switching component.

According to an embodiment of the switching device, a common arc guiding rail is provided for both of the movable contacts. The common arc guiding rail does not have a physically fixed connection with the movable switching component in order to reduce the moving mass.

According to another embodiment, the switching device provides a compact electric arc driver arrangement and electric arc extinguishing arrangement respectively comprising only one pair of arc guiding rails as well as only one deionization-extinguishing chamber per contact pair.

According to another embodiment of the switching device, the electric arc extinguishing arrangement is embodied as a component comprising two or more identical, serially arranged and tilted deionization-chambers per contact pair, wherein the side of the chambers facing the electric arc is arranged parallel to the electric arc being bulged in the direction of movement of the electric arc in the magnetic blow field.

According to another embodiment, the switching device comprises an electric arc extinguishing arrangement comprising a respective long deionization-extinguishing chamber per contact pair, wherein the individual extinguishing plates of the chambers are shifted and/or tilt against each other in such a way that the side of the extinguishing chamber facing the electric arc is directed parallel to the electric arc being bulged in the direction of movement of the electric arc in the magnetic blow field.

A first embodiment of a switching device for guiding and switching of load currents is explained in the following with reference to FIGS. 1 to 3.

The switching device 1 for guiding and switching of load currents comprises a movable switching component 100 having a first movable contact 10 and a second movable contact 20. The switching device further comprises a first fixed contact 30 and a second fixed contact 40. The switching device 1 further comprises a supporting device/bridge 200 to support the switching component 100. In a switched-on state of the switching component 100, the first movable contact 10 is in contact with the first fixed contact 30, and the second movable contact 20 is in contact with the second fixed contact 40. Furthermore, in a switched-off state of the switching component 100, the first movable contact 10 is electrically separated from the first fixed contact 30, and the second movable contact 20 is electrically separated from the second fixed contact 40. The switching component 100 is arranged such that the switching component is moved between the switched-on state and the switched-off state by a rotational movement of the switching component 100 and a translational movement of the supporting device 200.

The switching component 100 has a bearing position 101 at which the switching component 100 is rotatably arranged. The switching component 100 is mechanically coupled to the supporting device 200 at a force application area 102 of the switching component. The location of the force application area 102 is different from the location of the bearing position. The switching component 100 is arranged such that the switching component is moved between the switched-on state and the switched-off state by a rotational movement of the switching component 100 around the bearing position 101, and a translational movement of the supporting device 200. The translational movement of the supporting device acts on the switching component 100 at the force application area of the switching component 100. As a result, the bearing position of the switching component remains in a fixed position relative to the translational movement of the force application area 102 of the switching component, i.e. the bearing position is not translationally moved.

According to a possible embodiment, the switching device 1 comprises a magnetic actuator. The supporting device 200 and the magnetic actuator 300 are configured such that the translational movement of the supporting device 200 is caused by an activation of the magnetic actuator 300.

The switching component 100 is effective as a lever being configured such that the switching component performs the rotational movement around the bearing position 101, when the magnetic actuator 300 exerts a force to the force application area 102 of the switching component 100.

According to a possible embodiment of the switching device, the force application area 102 of the switching component 100 is arranged in relation to the bearing position 101 and a virtual connecting line between the first movable contact 10 and the second movable contact 20 such that a rotational movement of the force application area 102 of the switching component 100 causes a rotational movement of the first and second movable contact 10 and 20. The rotational movement of the first and second movable contact 10 and 20 is larger than the rotational movement of the force application area 102 of the switching component 100.

That means that the force application area is arranged at the rotatably embodied switching component 100 so that the switching component 100 is provided with a mechanical movement translation. The magnetic actuator 300 or the supporting device 200 acts on a short lever between the bearing position 101 and the force application area 102 so that a small (translational) movement of the magnetic actuator 300/supporting device 200 causes a large (rotational) movement of the movable contacts 10, 20.

Figure 2:
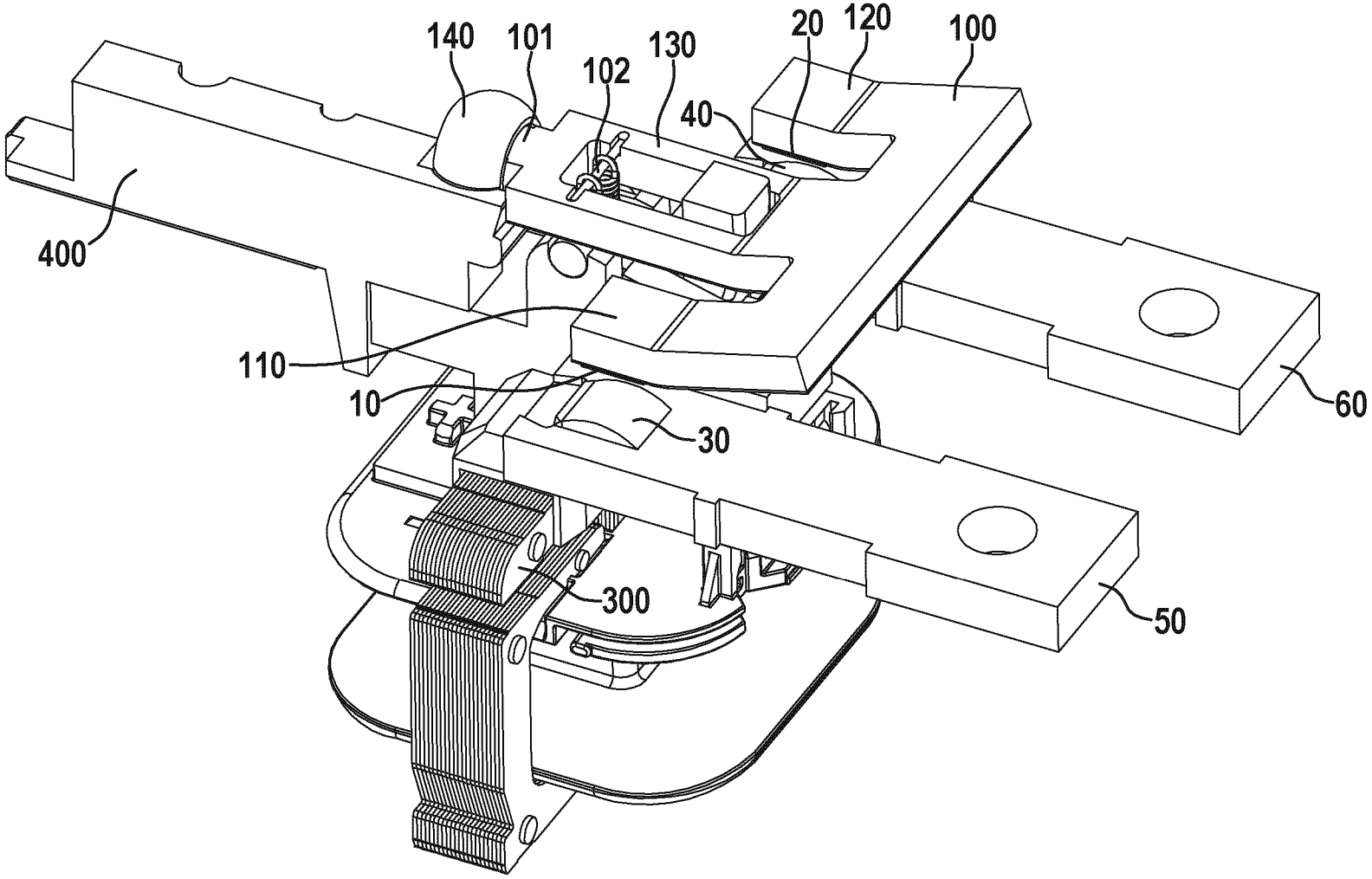
FIG. 2 illustrates a simplified view of a movable switching component and a magnetic actuator of a switching device for guiding and switching of load currents.
Figure 3:
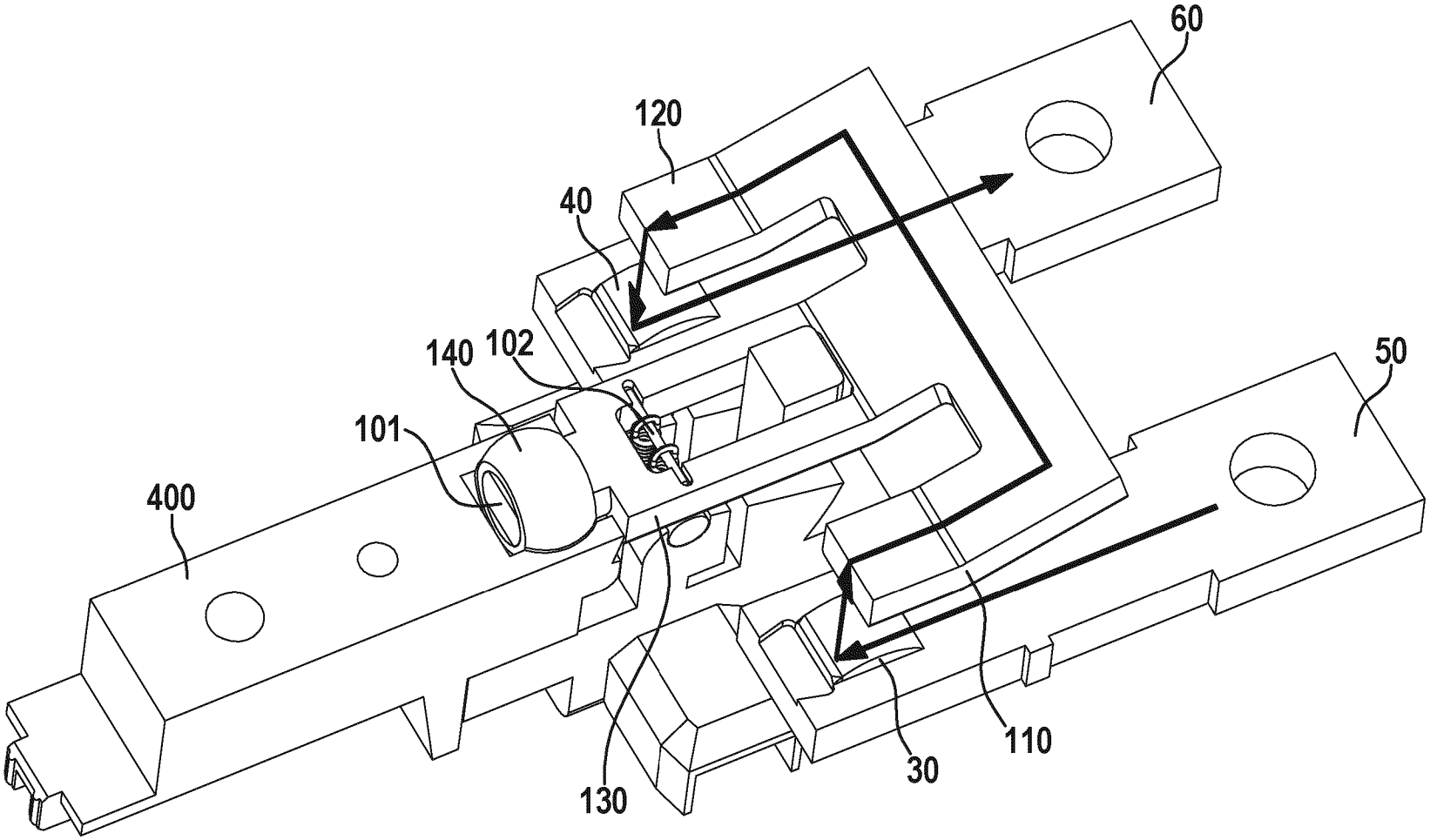
FIG. 3 illustrates a current path occurring in a switched-off state of the movable switching component of the switching device to build a dynamic magnetic blow field.

According to an embodiment of the switching device 1 shown in FIGS. 1 to 3, the switching component 100 is embodied as an E-shaped component having a first outer limb 110 and a second outer limb 120 and a middle limb 130. The middle limb 130 is arranged between the first outer limb 110 and the second outer limb 120. The middle limb 130 is longer than the first and the second outer limbs 110 and 120. The first movable contact 10 is arranged at an end portion of the first outer limb 110. The second movable contact 20 is arranged at an end portion of the second outer limb 120. The bearing position 101 of the switching component 100 is arranged at an end portion of the middle limb 130.

According to a possible embodiment of the switching device 1, the force application area 102 is arranged at a position of the middle limb 130 between the bearing position 101 and a virtual connecting line between the first movable contact 10 and the second movable contact 20.

According to another embodiment of the switching device 1 as shown in FIGS. 1 to 3, the switching component 100 is rotatably coupled to a holding device 400 by a ball-and-socket joint 140 placed at the bearing position 101 of the switching component. The end portion of the middle limb 130 is rotatably and tiltably arranged at a socket of the supporting device 400 which is part of the inner housing of the switching device 1. To minimize friction, the ball joint can be permanently provided with a suitable lubricant or be made of suitable materials with minimal surface friction, for example Teflon.

The force transmission of the magnetic actuator 300 to the movable switching component 100 takes place at the force application area 102 by a rotatable pawl connection. During the force transmission of the actuator 300 to the force application area 102, the socket of the holding device 400 and the bearing position 101 of the switching component 100 remains in an unchanged/fixed position. The force application area 102 is located between the ball joint 140 and a virtual connecting line between the first and second movable contacts 10 and 20. This gives the middle limb 130 the character of a lever arm which provides a rotational moving component during a switching operation when the contacts are moved in the opened and closed state. According to a possible embodiment, the force application area 102 may be located approximately in the middle between the ball joint 140 and the virtual connecting line between the first and second movable contacts 10 and 20.

As a result, in comparison to a pure linear movement of the switching component 100, a faster switching movement as well as an increased opening distance between the movable and fixed contacts is achieved. The switching device enables to realize a large opening path between the movable and fixed contacts within a short opening time of, for example, 2 ms. Since the mobility of a switching electric arc also increases with increasing distance between the fixed and movable contacts, the switching device allows the electric arc to move away from the switching contacts early. Moreover, the risk of re-ignition of an electric arc that has already been extinguished is also reduced by the increased total opening distance between the switching contacts 10, 30 or 20, 40.

The switching drive of the switching device 1 further allows to prevent welding of the switching contacts. When switching-on of high currents, there is the danger of contact welding caused by a short-term rebounding of the movable switching component 100 during first mechanical contact between the fixed and movable contacts, which is associated with a formation of short-term so-called bouncing arcs, when switching under load. If the arc power is sufficiently high, the switching contacts can be melted at certain points which results in welding of the contacts, when the contacts are immediately re-closed.

Contact welding can also occur in the case of short-circuit currents. A short-term rupture of the switching contacts may occur when the contacts open. This is caused by dynamic magnetic forces of the short-circuit currents due to the E-shape form of the movable switching component 100. The E-shape form will guide the current in such a way that it flows in the outer limbs 110, 120 of the movable switching component 100 in the opposite direction as in the terminal contact rails 50, 60. This will lead to an opening force on the movable switching component. The resulting high-energy arc causes a melting of the contact surfaces of the switching contacts which often leads to a welding in the case of a rapid re-closure of the switching contacts due to the fact that the switching drive is still in the "on-state" when the short circuit arc is extinguished and the dynamic opening forces fade away.

According to the embodiment of the switching device 1 shown in FIGS. 1 to 3, in the case of a contact welding, a torsional moment is effective at the movable switching component 100 and generates a force in the direction of the movement of the magnetic actuator 300 during the opening of the switching component 100. The torsional moment is caused by the force of the magnetic actuator 300 and the supporting device 200, the force impacting on the force actuation area 102 of the middle limb 130. The torsional moment facilitates a rupture of the already welded switching contacts.

Basically, the rotational movement component of the switching component 100 can be realized, for example, also by an annular support of bearing or by a cylindrical or a cylindrical conical support placed at the bearing position 101 of the switching component 100.

In order to minimize friction, the support can be provided with a suitable lubricant or can be made of suitable materials with a minimum of surface friction, for example Teflon.

A ball joint mounting suspension of the switching component offers the advantage of an additional lever effect to break the contact welding. If welding only occurs with one of the two contact pairs, for example due to the slightly different contact topography during re-contacting under load, but not with the other contact pair, the ball-and-socket joint suspension 140 of the switching component 100 causes an increased lever action on the welded pair of contacts along the virtual line of connection between ball joint and welded contact, which enables the welding to break.

Advantageous for a fast switch-off of both nominal currents as well as of over-currents and short-circuit currents is the reduction of the moving mass during switching operation. For most of conventional switching devices with arc driver components and arc extinguishing components, the movable switching component 100 is provided with guiding rails for fast leading-off of electric arcs.

According to an embodiment of the switching device 1, the 5 switching device comprises a common arc-guiding rail 500 for the first and the second movable contact 10, 20, as shown in FIG. 1. The common arc-guiding rail 500 is free of contact from the switching component 100 in the switched-on state of the switching component, and is only in contact with the switching component 100 in the switched-off state of the switching component. The common arc-guiding rail 500 includes a first arc guiding rail portion 511, a second arc-guiding rail portion 521 and a linking portion 501 connecting the first and second arc guiding rail portions.

The switching device 1 comprises a first electric arc extinguishing chamber 600 and a second electric arc extinguishing chamber 700. A first pair 510 of arc guiding rails is arranged between the first electric arc extinguishing chamber 600 and a pair of the first movable contact 10 and the first fixed contact 30. A second pair 520 of arc guiding rails is arranged between the second electric arc extinguishing chamber 700 and a pair of the second movable contact 20 and the second fixed contact 40.

As illustrated in FIG. 1, the first pair 510 of the arc guiding rails comprises the first arc guiding rail portion 511 being arranged between the first movable contact 10 and the first electric arc extinguishing chamber 600. The second pair 520 of the arc guiding rails comprises the first arc guiding rail portion 521 being arranged between the second movable contact 20 and the second electric arc extinguishing chamber 700. The first arc guiding rail portion 511 of the first pair 510 of the arc guiding rails and the first arc guiding rail portion 521 of the second pair 520 of the arc guiding rails may be formed as a part of the common arc guiding rail 500.

According to a possible embodiment of the switching device 1 shown in FIG. 1, the first arc guiding rail portion 511 of the first pair 510 of the arc guiding rails is formed as an extension of an extinguishing plate 601 of the first electric arc extinguishing chamber 600. The first arc guiding rail portion 521 of the second pair 520 of the arc guiding rails is formed as an extension of an extinguishing plate 701 of the second electric arc extinguishing chamber 700. The first arc guiding rail portion 511 of the first pair 510 of the arc guiding rails and the first arc guiding rail portion 521 of the second pair 520 of the arc guiding rails is free of contact from the switching component 100 in the switched-on state of the switching component.

The arc guiding rails for the movable contacts are not directly connected to the movable switching component 100 in order to reduce the moved mass of the movable switching component 100. The first arc guiding rail portions 511 and 521 are connected by the linking portion 501 and thus are formed as a single sheet with an approximately U-shaped profile. The outer ends of the arc guiding rail portions 511 and 521 are directly connected to the end extinguishing plates 601, 701. The outer ends of the arc guiding rail portions 511 and 521 are designed as end extinguishing plates 601 and 701 at the end of the two electric arc extinguishing chambers 600 and 700.

The bow-shaped, common arc guiding rail 500 including the guiding rail portions 511 and 521 and the linking portion 501 is permanently connected to the housing of the switching device. In the switched-on state of the switching component 100, there is no physical connection between the common arc guiding rail 500 and the movable switching component 100. The upper surface of the movable switching component 100 is only in physical contact with the bow-shaped inner portion of the arc guiding rail 500 in the switched-off state of the movable switching component 100. As a consequence, the electric arcs occurring in the magnetic blow field between the opening contacts can move away towards the electric arc extinguishing chambers 600 and 700 in the same way as in the case of a fixed and rigid connection between the arc guiding rail 500 and the movable switching component 100.

As best shown in FIG. 3, the switching device 1 comprises a first terminal contact rail 50 and a second terminal contact rail 60. The first fixed contact 30 is placed on the first terminal contact rail 50, and the second fixed contact 40 is placed on the second terminal contact rail 60. A first current path is formed in the switched-on state of the switching component 100 or when switching off and a current-conducting arc occurs between the first outer limb 110 of the switching component and the first terminal contact rail 50, and is formed in a U-shape. Similarly, a second current path is formed between the second outer limb 120 of the switching component 100 and the second terminal contact rail 60 in a U-shape.

To achieve a high dynamic magnetic field strength in the event of a short-circuit, the movable switching component 100 is embodied in such a way that it has an E-shaped profile, as explained above. Due to this shape of the movable switching component 100, the first and second current paths generated by the formation of the electric arc in the switched-on state of the switching component 100, or when a switching arc occurs, respectively have a U-shape. In the case of a short-circuit current these U-loops cause both a dynamic opening force and a strong dynamic blow field on both sides which causes the electric arcs of both contact pairs 10, 30 and 20, 40 to quickly move in the direction of the respective electric arc extinguishing chambers 600 and 700 independent from the direction of the current flow.

For the arc extinguishing in the case of nominal currents, each of the two contact pairs of contacts 10, 30 and 20, 40 as well as the arc guiding rail portions 511, 521 are arranged inside a permanent magnetic driver arrangement 800. As shown in FIG. 1, the permanent-magnetic driver arrangement 800 includes a centrally arranged rectangular permanent magnet 810 with lateral pole plates 820. The desired distance between these pole plates 820 and the movable contacts 10 and 20 may be adjusted by a rectangular, magnetic flux conductive ferromagnetic spacer or spacers 830, the side surfaces of which each have a contact to the magnetic pole 810 and one of the pole plates 820 over its entire surface.

In the permanent-magnetic blow field built up in this way, one of both electric arcs moves in the direction of one of the electric arc extinguishing chambers 600, 700, whereas the other one of the electric arcs moves in the opposite direction towards a wall of a switching chamber of the switching device, when the movable switching component 100 is moved in the switched-off state under load depending on the 30 direction of the current flow. The wall of the switching chamber is made, at least in this area, of an insulating material of sufficient thermal stability.

It may be possible that the electric arc running in the direction towards the switching chamber wall does not come into direct contact with the chamber wall, because the other one of the electric arcs simultaneously running towards one of the electric arc extinguishing chambers immediately extinguishes when arriving in the extinguishing chamber. This is achieved by the fact that these so-called deionization extinguishing chambers 600 and 700 are equipped with a large number of extinguishing plates 601, 701 so that in this way a high total arc voltage is formed very quickly due to the division of the arc into a corresponding number of partial arcs. The high total arc voltage ensures that the two electric arcs extinguish quickly when the total arc voltage is higher than the driving voltage applied between the first terminal contact rail 50 and the second terminal contact rail 60.

In the case of short-circuit currents, the magnetic field strength of the dynamic blow field produced by the shape of the movable switching component 100 exceeds the strength of the permanent magnetic field. As a consequence, each of the electric arcs will be always driven in one of the electric arc extinguishing chambers 600, 700 independent from the direction of current flow so that the partial arcs formed by both of the electric arcs will generate a high total voltage very quickly.

In this way, the switching device 1 allows to realize an arc driver and arc extinguishing arrangement being embodied as a compact switch for high switching power with only two deionization electric arc extinguishing chambers. The limitation to only two contact pairs offers the additional advantage that the heat emitted from the contact pairs, when guiding large currents, is low which in turn is beneficial for the realization of a compact switching device.

Figure 4:
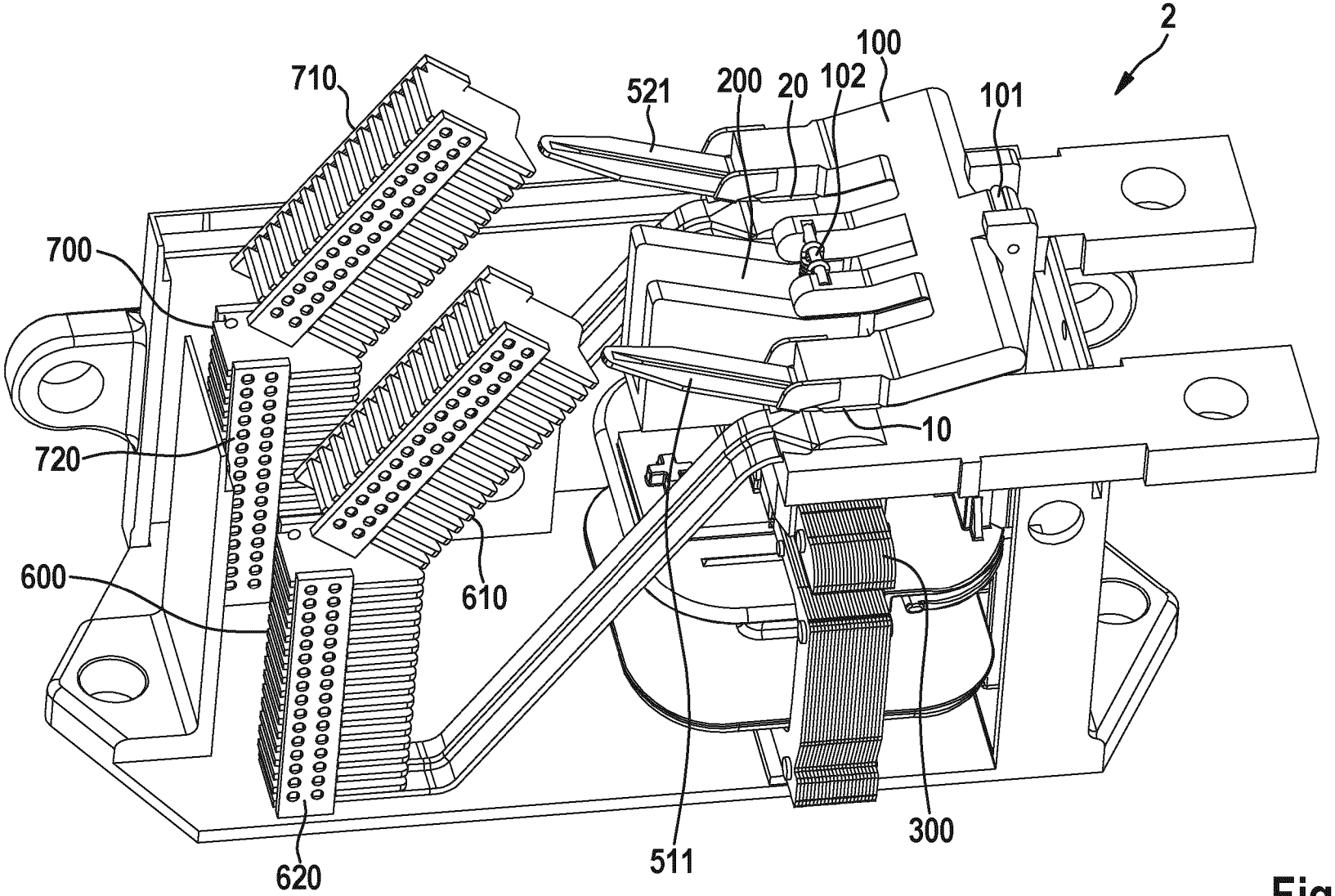
FIG. 4 shows a second embodiment of a switching device for guiding and switching of load currents.

FIG. 4 shows a second embodiment of the switching device 2.

The switching component 100 is moved by a translational and rotational movement of the switching component. In order to move the switching component 100 from the switched-off state to the switched-on state, the supporting device 200 to support the switching component 100 is moved by a translational movement downwards. The translational movement of the supporting device 200 is caused by the activation of the magnetic actuator 300. When the movable contacts 10, 20 come in contact with the fixed contacts, the supporting device 200 is moved further downwards by the translational movement which causes a rotational movement of the switching component 100 around a bearing point 101.

According to the advantageous embodiment of the switching device shown in FIG. 4, the first electric arc extinguishing chamber 600 and the second electric arc extinguishing chamber 700 comprise at least a first portion of extinguishing plates 610, 710 and at least a second portion of extinguishing plates 620, 720. As shown in FIG. 4, the first portion of the extinguishing plates 610, 710 is slanted towards the switching component 100 in relation to the second portion of the extinguishing plates 620, 720.

According to the embodiment of the switching device 2 shown in FIG. 4, the arc extinguishing device comprises two 30 separate, serially connected identical extinguishing chambers 600 and 700 for each of the contact pairs. The two upper sub-chambers 610 and 620 facing the movable switching component 100 are tilted against the lower sub-chambers 620, 720 in such a way that in each case the uppermost extinguishing plate 601, 701 of the two upper extinguishing sub-chambers 610, 710 have only a small distance to the ends of the arc guiding rail portions 511 and 521, when the movable switching component 100 is moved in the complete switched-off state.

The tilted arrangement of the arc extinguishing chambers 600 and 700 allows to reduce the length of the arc guiding rail portions 511, 521 on the side of the movable switching component 100 which results in a fast running-in of the electric arcs into the extinguishing chambers 600 and 700.

A further advantage of the tilted arc extinguishing chambers is that the outer edge of the arrangement of the extinguishing plates approximately has the contour of the bulging arc bulged in the magnetic blow field in the direction of movement of the electric arc. This especially favors in deionization chambers, which are equipped with a large number of extinguishing plates, the simultaneous running-in of the entire electric arc front into the extinguishing system and thus the rapid extinction of the arc.

As an alternative of tilting two identical deionization chambers, the arc extinguishing system may comprise an arrangement of several identical short deionization chambers, each of which is tilted against each other at a small angle.

According to another embodiment of the switching device, the first electric arc extinguishing chamber 600 and the second electric arc extinguishing chamber 700 respectively comprise a plurality of extinguishing plates. The extinguishing plates are displaced or slanted against each other such that a respective side of the first and second electric arc extinguishing chamber 600, 700 is placed in parallel to an electric arc being curved in a magnetic blow field of the switching device in the running direction of the electric arc. This embodiment of an extinguishing system comprising only one long extinguishing chamber, the individual extinguishing plates of which are displaced and/or tilted against each other so that the front face of the extinguishing chamber facing the arc front is approximately parallel to the bulged arc in the magnetic blowing field, is not shown in the figures.

For the embodiments with tilted extinguishing chambers or extinguishing plates being tilted and/or displaced, the short arc guiding rails 511, 521 on the side of the movable switching component 100 may either fixed to the movable switching component 100, or they may form a common part with the movable switching component 100 in the form of an extended end of the movable switching component 100.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 first embodiment of switching device
2 second embodiment of switching device
10 first movable contact
20 second movable contact
30 first fixed contact
40 second fixed contact
50 first terminal contact rail
60 second terminal contact rail
100 movable switching component
101 bearing position
102 force application area
110 first outer limb
120 second outer limb
130 middle limb
140 ball-and-socket joint
200 fixed contact bridge
300 magnetic actuator
400 supporting device
500 arc guiding rail
501 linking portion of first and second arc guiding rail portions
510 first pair of arc guiding rails
511 first arc guiding rail portion
520 second pair of arc guiding rails
521 second arc guiding rail portion
600 first electric arc extinguishing chamber
601 extinguishing plate
610 first portion of extinguishing plates
620 second portion of extinguishing plates
700 second electric arc extinguishing chamber
701 extinguishing plate
710 first portion of extinguishing plates
720 second portion of extinguishing plates
800 permanent magnetic driver arrangement
810 permanent magnet
820 pole plate
830 Spacer

The invention claimed is:

1. A switching device for guiding and switching of load currents, comprising:

a movable switching component having a first movable contact- and a second movable contact;

a first fixed contact and a second fixed contact;

a supporting device configured to support the switching component; and a magnetic actuator, wherein the first movable contact is in contact with the first fixed contact and the second movable contact is in contact with the second fixed contact in a switched-on state of the switching component, wherein the first movable contact is electrically separated from the first fixed contact and the second movable contact is electrically separated from the second fixed contact in a switched-off state of the switching component, wherein the switching component is arranged such that the switching component is configured to move between the switched-on state and the switched-off state by at least a rotational movement of the switching component and a translational movement of the supporting device, wherein the supporting device and the magnetic actuator are configured such that the translational movement of the supporting device is caused by an activation of the magnetic actuator, wherein the switching component has a bearing position at which the switching component is rotatably arranged, wherein the switching component is mechanically coupled to the supporting device at a force application area of the switching component, wherein a location of the force application area is different from a location of the bearing position, wherein the switching component comprises an E-shaped component having a first outer limb, and a second outer limb, and a middle limb being arranged between the first outer limb and the second outer limb, the middle limb being longer than the first and the second outer limbs, wherein the first movable contact is arranged at an end portion of the first outer limb and the second movable contact is arranged at an end portion of the second outer limb, wherein the bearing position of the switching component is arranged at an end portion of the middle limb, and wherein the force application area is arranged at a position of the middle limb between the bearing position and a virtual connecting line between the first movable contact and the second movable contact.

2. The switching device of claim 1, wherein the switching component is configured as a lever such that the switching component performs the rotational movement around the bearing position, upon the magnetic actuator exerting a force on the force application area of the switching component.

3. The switching device of claim 2, wherein the switching component is rotatably coupled to a holding device by a ball-and-socket joint placed at the bearing position of the switching component.

4. The switching device of claim 1, wherein the force application area of the switching component is arranged in relation to the bearing position and a virtual connecting line between the first movable contact and the second movable contact such that a rotational movement of the force application area of the switching component is configured to cause a rotational movement of the first and second movable contact larger than the rotational movement of the force application area of the switching component.

5. The switching device of claim 1, further comprising:

a common arc guiding rail for the first and the second movable contact, wherein the common arc guiding rail is free of contact from with the switching component in the switched-on state of the switching component.

6. The switching device of claim 5, further comprising:

a first electric arc extinguishing chamber; and a second electric arc extinguishing chamber.

7. The switching device of claim 6, further comprising:

a first pair of arc guiding rails arranged between the first electric arc extinguishing chamber and a first pair of the first movable contact- and the first fixed contact; and a second pair of arc guiding rails arranged between the second electric arc extinguishing chamber and a second pair of the second movable contact- and the second fixed contact.

8. The switching device of claim 7, wherein the first pair of the arc guiding rails comprises a first arc guiding rail portion arranged between the first movable contact and the first electric arc extinguishing chamber, wherein the second pair of the arc guiding rails comprises a first arc guiding rail portion arranged between the second movable contact- and the second electric arc extinguishing chamber, and wherein the first arc guiding rail portion of the first pair of the arc guiding rails and the first arc guiding rail portion of the second pair of the arc guiding rails are formed as a part of the common arc guiding rail.

9. The switching device of claim 8, wherein the first arc guiding rail portion of the first pair of the arc guiding rails is formed as an extension of an extinguishing plate of the first electric arc extinguishing chamber, and wherein the first arc guiding rail portion of the second pair of the arc guiding rails is formed as an extension of an extinguishing plate of the second electric arc extinguishing chamber.

10. The switching device of claim 6, wherein the first electric arc extinguishing chamber and the second electric arc extinguishing chamber comprise at least a first portion of extinguishing plates and at least a second portion of extinguishing plates, and wherein the first portion of the extinguishing plates is slanted towards the switching component in relation to the second portion of the extinguishing plates.

11. The switching device of claim 6, wherein the first electric arc extinguishing chamber and the second electric arc extinguishing chamber respectively comprise a plurality of extinguishing plates, and wherein the extinguishing plates are displaced or slanted against each other such that a respective side of the first and second electric arc extinguishing chamber is placed in parallel to an electric arc being curved in a magnetic blow field of the switching device in a running direction of the electric arc.

12. The switching device of claim 1, further comprising:

a first terminal contact rail; and a second terminal contact rail, wherein the first fixed contact is placed on the first terminal contact rail- and the second fixed contact is placed on the second terminal contact rail-.

* * * * *